US009067455B2

(12) United States Patent
Shoffstall-Ridley

(10) Patent No.: US 9,067,455 B2
(45) Date of Patent: Jun. 30, 2015

(54) TABBED PAPER FOR ANNOTATION OF DOCUMENTS INCLUDING BOOK INSERTS

(71) Applicant: Drevvis A. Shoffstall-Ridley, Englewood, CO (US)

(72) Inventor: Drevvis A. Shoffstall-Ridley, Englewood, CO (US)

( * ) Notice: Subject to any disclaimer, the term of this patent is extended or adjusted under 35 U.S.C. 154(b) by 0 days.

(21) Appl. No.: 13/936,167

(22) Filed: Jul. 6, 2013

(65) Prior Publication Data

US 2014/0015241 A1 Jan. 16, 2014

Related U.S. Application Data

(63) Continuation-in-part of application No. 13/280,728, filed on Oct. 25, 2011, now abandoned, which is a continuation of application No. 11/867,505, filed on Oct. 4, 2007, now abandoned.

(51) Int. Cl.

| | |
|---|---|
| ***B42D 15/00*** | (2006.01) |
| ***B42D 9/00*** | (2006.01) |
| ***B42D 13/00*** | (2006.01) |
| ***B42F 21/02*** | (2006.01) |
| ***B42F 21/06*** | (2006.01) |

(52) U.S. Cl.

CPC ..... *B42D 15/00* (2013.01); *B42D 9/008* (2013.01); *B42D 9/004* (2013.01); *B42D 13/00* (2013.01); *B42F 21/02* (2013.01); *B42F 21/06* (2013.01)

(58) Field of Classification Search

CPC ..... B42D 9/004; B42D 9/008

USPC ..... 281/2, 38; 402/79; 116/234, 238–239; 283/37–40

See application file for complete search history.

(56) References Cited

U.S. PATENT DOCUMENTS

| | | | | |
|---|---|---|---|---|
| 2,510,053 | A | | 6/1950 | Pfeiffer |
| 3,324,823 | A | | 6/1967 | Peters |
| 3,492,743 | A | | 2/1970 | Schmidt |
| 4,422,672 | A | * | 12/1983 | Levi ..... 281/38 |
| 4,573,821 | A | | 3/1986 | Gilreath |
| D289,423 | S | | 4/1987 | Lawrence |
| 4,884,826 | A | | 12/1989 | Slagsvol |
| 4,961,811 | A | * | 10/1990 | Haugwitz ..... 428/198 |
| 4,970,984 | A | * | 11/1990 | Vazquez ..... 116/234 |
| 4,980,212 | A | | 12/1990 | Marquis et al. |
| 5,029,899 | A | | 7/1991 | Schieppati |

(Continued)

FOREIGN PATENT DOCUMENTS

WO WO 2006/021795 3/2006

OTHER PUBLICATIONS

International Preliminary Report on Patentability for international application PCT/US2008/078603, date of issuance of report Apr. 7, 2010.

*Primary Examiner* — Kyle Grabowski
(74) *Attorney, Agent, or Firm* — Lathrop & Gage LLP

(57) ABSTRACT

Transparent or substantially transparent sheets of paper or similar material suitable for inserting into a book or placed over a document are used to highlight or annotate a document without permanently marking or damaging the page. The inserts are thin enough so as to allow several inserts to be placed within a book without significantly increasing the book thickness or distorting the shape and size of the book when closed. Additionally, the inserts contain one or more tabs to allow a user to index and quickly find a particular insert and the corresponding page. An adhesive is present on the rear side of the insert to fix the insert to the page being annotated.

18 Claims, 2 Drawing Sheets

(56) References Cited

U.S. PATENT DOCUMENTS

| | | | | |
|---|---|---|---|---|
| 5,056,825 | A | 10/1991 | Templet | |
| 5,366,776 | A | 11/1994 | Mertens | |
| 5,388,861 | A | 2/1995 | Reiter | |
| 5,599,128 | A | 2/1997 | Steiner | |
| 2,791,040 | A | 5/1997 | Santorelli | |
| 5,743,566 | A | 4/1998 | Hunter et al. | |
| 6,582,546 | B1 * | 6/2003 | Micek | 283/67 |
| 7,128,957 | B2 | 10/2006 | Bratter | |

* cited by examiner

TABBED PAPER FOR ANNOTATION OF DOCUMENTS INCLUDING BOOK INSERTS

CROSS REFERENCE TO RELATED APPLICATIONS

The application is a continuation-in-part of U.S. application Ser. No. 13/280,728, filed on Oct. 25, 2011, which claims priority to U.S. application Ser. No. 11/867,505, filed on Oct. 4, 2007, both of which are incorporated by reference in their entirety.

BACKGROUND OF THE INVENTION

The present invention relates to a thin sheet of tabbed tracing paper, vellum, tissue paper or similar material inserted in a book to allow a user to highlight, mark or annotate a passage in the book without having to mark the actual page.

While reading or researching a book or other type of document, it is often desirable to make notes or highlight particular passages throughout the book or document and to be able to flip between the different annotated pages. For example, a student may find it helpful to make notes in the margins of a textbook or highlight particular paragraphs. It would be highly preferable if this could be done without permanently marking or damaging the pages. For instance, the prices of college textbooks have created a market for used textbooks and a less marked-up textbook would have a higher resale value. The present invention permits a user to annotate a textbook without negatively affecting its physical condition. The annotating can occur in the context of a real-time lecture in addition to other contexts such as regular reading or study sessions.

It is sometimes also desirable for multiple persons to review and annotate multiple pages in a large document, such as a group review of a report or a group Bible study, without physically damaging the source document. Preferably, there should be a quick and easy way to annotate multiple pages in the document, index the notes, and flip to between the multiple inserts.

Transparent overlay devices have been known for some time in the art, for example U.S. Pat. Nos. 1,450,261; 1,510,110; 2,791,040; 3,324,823; 5,029,899 and 5,388,861. These prior art devices typically consist of a transparent overlay permanently or semi-permanently attached to the cover or bindings of the book or document. For example, U.S. Pat. No. 2,791,040 discloses a single sheet of transparent acetate placed over a map to allow a navigator to chart a course without marking the map. The acetate sheet is part of an erasable pocket on the exterior of a map folio holding the map or drawing. Similarly, U.S. Pat. No. 1,510,110 teaches a hinged transparent sheet attached to a map guide, and U.S. Pat. No. 1,450,261 discloses a book with tracing paper attached to the outer edge of the book cover which folds over the pages of text. These transparent overlays are limited in that they are part of bulky covers or document holders and are only used with the books or maps placed within the holder or cover. These devices are not convenient to use if a reader wants to annotate multiple books or documents, or multiple pages within the same book or document while retaining the previous notes.

U.S. Pat. No. 4,970,984 discloses memo marking tabs which can be easily inserted into a document. These marking tabs, however, are made from heavy gauge paper making them non-transparent. While non-transparent inserts still allow for notes to be placed in the document, they cover the printed information on the page. Additionally, inserts made from heavy gauge paper significantly increasing the thickness of the document if multiple tabs are used.

What is needed is a device for easily annotating or highlighting one or more pages of printed material without leaving permanent marks while still allowing the printed material to be seen and read. It is also desirable for the notes or highlights to be easily removable, reattached or stored for future reference.

SUMMARY OF THE INVENTION

The present invention provides an insert for placing over a page of a book or other document so as to allow annotation of the page. The inserts are thin enough so as to allow a large number of inserts to be placed within a document without significantly increasing the document thickness or distorting the shape and size of the document when closed. The inserts of the present invention comprise a sheet of transparent or substantially transparent material, and one or more tabs that extend from the outer edges of the sheet to allow a user to index and quickly find a particular insert and the corresponding document page. The sheet has a front face and rear face where the front face is receptive to pencil and ink marks. Optionally, at least one portion of the rear face of the sheet has an adhesive allowing the insert to be affixed to the page.

The inserts of the present invention can be used with books and documents of almost any type. For example, business documents such as draft press releases, FDA submissions, or regulatory SEC filings that need to be reviewed by multiple personnel represent possibilities for employing articles and methods of the invention. Another general application of the present invention is in the context of a small study group where there is a common practice of sharing a single source document or study guide by each of the group members.

The present invention also provides a method of annotating a page of a document (such as book, study guide, report, etc.) comprising the steps of a) providing an insert which comprises a thin sheet of transparent or substantially transparent material having a front face and a rear face, and one or more tabs extending from the sides of the sheet, where the front face is receptive to pencil and ink marks, and at least one portion of the rear face contains an adhesive; b) positioning the insert relative to a desired document page so that the adhesive contacts the document page; and c) annotating the insert. In a further embodiment, the adhesive allows temporary fixation to the document page and allows the entire sheet to be removed without ripping or tearing the page or the insert. In a further embodiment, the removed annotated sheet is later reattached to the same document page or to a different document page and annotated further. In another embodiment, multiple inserts are positioned onto multiple different pages in the same document and annotated. The tabs extend beyond the edges of the document allowing a user to find and turn to a particular insert.

In a further embodiment, the insert sheet or portions of the insert sheet are tinted with a color and positioned over a desired section of the document page in order to highlight the desired section. It is believed the color highlight makes the desired section easier to read, particularly with individuals with vision or reading disabilities.

An insert of the present invention is preferably thin. The insert sheet should have a small enough thickness to be flexible, at least substantially transparent, and not significantly add to the weight or thickness of the annotated book or document. The insert sheet should have a sufficient thickness so writing on the insert does not cause ripping or tearing. Thickness is typically described for paper in multiple ways. An absolute measurement of thickness of a single sheet of paper is typically made in mils, where 1 mil=1/1000 inch. Alternatively, thickness can be determined by weight per 500 sheets of a standard size of paper, and by the paper industry standard of grams per square meter (gsm), also called grammage, as set forth by the International Organization for Standardization (ISO). Standard letter size paper (8½ by 11 inches) is often described as 20 pound paper (with 20 pounds being the weight of 500 sheets of uncut 17"×22" paper, which the paper manufacturer will then cut into 4 letter-sized reams). Therefore, 500 sheets of 20 pound letter sized paper will weigh approximately 5 pounds. Typical letter size paper has a grammage of approximately 80 gsm.

One embodiment of the present provides inserts comprising a sheet having a thickness of approximately 0.25 to 3 mils, more preferably a thickness of approximately 0.5 to 2.5 mils, even more preferably a thickness of approximately 1 to 1.5 mils.

Another embodiment of the present invention provides inserts comprising a sheet having between about 10 and about 60 gsm, more preferably between about 10 and about 40 gsm, even more preferably between about 15 and about 30 gsm.

Another embodiment of the present invention provides inserts where 500 sheets of letter size inserts weigh between approximately 1.25 and 2.5 pounds, more preferably between 1.5 and 1.75 pounds. It should be noted that the thickness values for one embodiment may not completely overlap with another embodiment. For example, an insert sheet having a thickness of approximately 3 mils may have a grammage greater than 60 gsm.

Particularly for popular conventional paper stocks used in the publishing industry, the thickness of an annotated insert of the present invention can be described relative to the paper stock, i.e., the thickness of the insert is less than or equal to a specified percentage of the thickness of the document page. In one embodiment, the thickness of the insert is no more than about 2% to about 80% of the document sheet thickness, more preferably no more than about 50%.

In one embodiment, the sheet is flexible enough to allow the insert to be folded while positioned on the document page. In a further embodiment, both the front face and rear face are receptive to pencil and ink marks. This allows the insert to be positioned onto a document page, a portion of the insert to be folded over thereby exposing a portion of the document page, and the rear face of the folded portion of the insert to be annotated. For example, where the text on the document page is provided in columns, the insert is placed over the document page and is folded to expose one or more of the columns of the underlying document page, and the rear face of the insert annotated next to the desired column.

The inserts of the present invention have one or more tabs extending from the outer edges of the sheet. The one or more tabs are analogous to the size and shape of tabs that are found on a conventional manila file folders or 3-ring binder dividers. In one embodiment, the insert contains two to six tabs depending on the size of the document to be annotated and the size of the insert. The tabs can be positioned anywhere along the top of the sheet, the bottom of the sheet, the side of the sheet opposite from the binding, or a combination thereof. Preferably, no tabs are positioned at the edge of the sheet that is positioned along the binding of the annotated book or document. The tabs may be made from the same material as the sheet and may form a seamless structure with the sheet. Alternatively, the tabs may be made from a different material and attached, such as by glue, to the rest of the sheet.

The tab feature allows for indexing the annotations made to the book or document and is particularly useful for finding specific annotations or pages in a book or document containing multiple inserts. In one embodiment, the tabs of different inserts are located at different positions along the top, bottom or side of the sheet so that the tabs of the separate inserts will not overlap each other when multiple inserts are placed in the same book or document. In one embodiment, the tabs are also color coded to assist in differentiating between the tabs. In another embodiment, the tabs are thin enough to allow the tab to be more flexible and bend without ripping or tearing compared to harder or thicker tabs. This can enhance the resiliency and durability of the tab. For example, when the insert is left in a book, the book can be repeatedly shelved while not substantially diminishing the tab integrity.

The adhesive is optionally present in one or more areas on the surface of the rear face of the sheet. In one embodiment, this area is a strip along the side or top of the sheet. This strip can correspond to the margins of the document page so that the adhesive does not contact the text of the document. Adhesive note pads or sticky notes known in the art have relatively thick strips of adhesives which can cause ripping or tearing of the insert or document page when the insert is removed. Preferably the adhesive is present in small enough amounts that the insert or pages of the document are not ripped when the insert is removed. In one embodiment, the adhesive is present as one or more circular areas or dots on the rear face of the sheet. In a further embodiment, the adhesive dots are spread along the side or top of the sheet starting approximately half of an inch to one inch from one edge of the sheet and continuing to approximately half of an inch to one inch from the opposite edge. This strip of adhesive dots can also be positioned so that it contacts the margin of the document page. The use of adhesive dots provides a sufficient adhesive force across the sheet and allows the insert to be removed from the document page without ripping the document page or the insert. The use of adhesive dots is preferable over a solid adhesive strip because a smaller area of the original document will come into contact with the adhesive thereby reducing the chance that the original document will be pulled up, marked or torn when the adhesive is removed. This is especially beneficial if the sheet is being inserted over a piece of art work (an old text of natural science pictures for instance). In a further embodiment, the rear face of the insert sheet does not contain any compound or material that will mark the underlying document page when the front face of the insert sheet is written on or pressed on. This will additionally ensure that the underlying document page is not marked or damaged by using the insert.

DETAILED DESCRIPTION

As used herein, "annotate" and "annotating" broadly refers to writing notes (including but not limited to letters, numbers, symbols and words), drawing, underlining, highlighting, coloring, shading or otherwise marking a writable surface in relation to a printed document. Annotations can be made on the same page of a document of interest; however, it is the objective of the present invention that annotations are made on transparent or substantially transparent inserts placed over the document of interest. Materials suitable for inserts of the present invention include paper of all types, particularly tissue paper and tracing paper, vellum, and similar materials commonly used as writing surfaces that are receptive to pencil and ink marks.

By "receptive to pencil and ink marks" it is meant that it easy to mark the surface with a ballpoint pen, pencil, highlighter or other common writing utensil. Other protective covers and inserts, such as plastic transparencies, are not easily marked by ballpoint pen or pencil and may require markers adapted for marking that particular material. This makes it inconvenient to annotate the document.

The inserts of the present invention comprise a sheet that is transparent or at least substantially transparent similar to conventional tracing paper. As used herein, "substantially transparent" should be understood as permitting sufficient passage of light to permit the viewing of an underlying image, particularly the text of a book or other document. The sheet covers at least a portion of the relevant text on the document and is typically rectangular but can be any shape. In the present invention, the sheet is transparent or substantially transparent so that the underlying document can be seen and read while the insert is placed over the document. This allows the notes or highlights to be placed and read in the correct position relative to the original text.

Figure 1:
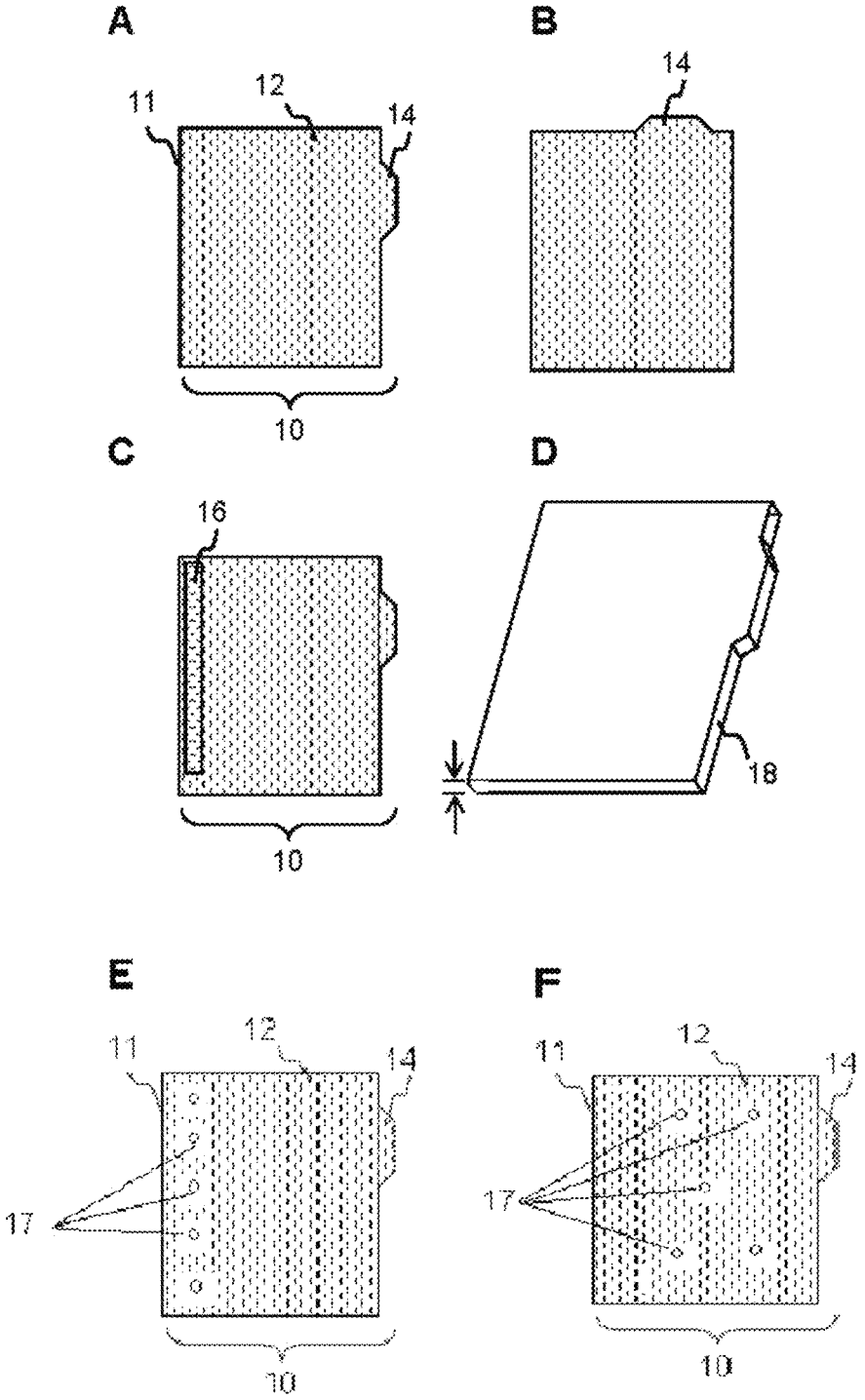
FIG. 1A and FIG. 1B show an insert of the present invention having a tab positioned on the side (FIG. 1A) of the sheet or on the top (FIG. 1B) of the sheet.
FIG. 1C shows an insert having an adhesive strip on the rear face of the sheet.
FIG. 1D illustrates the thickness of an insert of the present invention.
FIGS. 1E and 1F show an insert having a plurality of circular adhesive dots on the rear face of the sheet in different configurations.

FIG. 1A and FIG. 1B show an insert 10 of the present invention having a sheet 12, an interior or binding edge 11 of the sheet 12, and a projecting tab 14 which can be present on any non-interior edge such as the side (FIG. 1A) or the top of the insert (FIG. 1B). Typically, the insert 10 will be placed over a document page so that the interior or binding edge 11 is along the side of the page next to the binding. FIG. 1C shows the rear face of an insert 10 having an adhesive section 16. Preferably when the insert 10 is placed over a document page, the adhesive section 16 is positioned so that it contacts the margin of the page next to the binding. In this embodiment, the adhesive section 16 is a strip that is indented from the edges of the sheet 12, preferably by at least ½ of an inch from the top and bottom edges and up to ¾ of an inch from the binding edge 11. FIG. 1D shows an insert 10 having a depth/thickness of dimension 18. Preferably dimension 18 is comparable to that of conventional tracing paper, vellum, and/or tissue paper. In one embodiment of the present, the insert thickness 18 is approximately 1 to 1.5 mils.

FIG. 1E shows the rear face of an insert 10 having a plurality of circular adhesive dots 17 instead of an adhesive strip. For an insert that is 7 inches by 9 inches or larger, the adhesive dots 17 need not be more than 2 mm in diameter and are as small as 1 mm in diameter. The adhesive dots are spaced between 1 cm and 3 cm apart from one another and can be arranged in a straight line across the sheet 12, or can be arranged in other configurations, such as a group of dots at each corner of the sheet 12, or a groups of dots positioned toward the center of the sheet 12 as shown in FIG. 1F. In one embodiment, each of the adhesive dots 17 are positioned at least 1.27 cm away from the closest edge. In a further embodiment, each of the adhesive dots 17 are positioned at least 2.54 cm away from the closest edge. In a further embodiment, each of the adhesive dots 17 are positioned at least 3.8 cm away from the closest edge. The adhesive dots 17 can be smaller than 1 mm in diameter (as small as 0.5 mm) for smaller sized inserts. The infrequency of the adhesive dots 17 and the minimal size help protect the original document from tearing and are less likely to leave residual adhesive on the document page.

Figure 2:
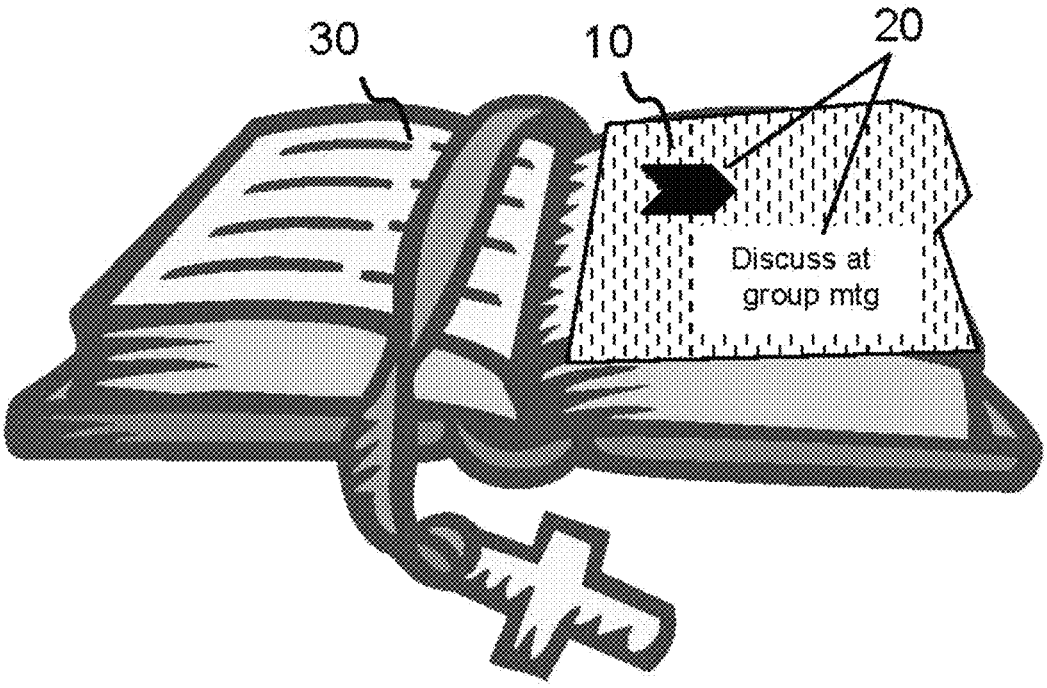
FIG. 2 shows an insert of the present invention positioned relative to a page in a document.

FIG. 2 shows an insert 10 of the present invention positioned relative to a page in a document 30. Annotations 20 are provided by a user writing directly on sheet 10 while it is positioned on top of document 30 and can be text or other kind of mark or highlight.

The adhesive on the rear face of the sheet allows the insert to be temporarily fixed to the document page. The adhesive allows positioning of the insert relative to the document information content. For example, a user can conveniently place text-based lecture notes or study notes on the insert next to the relevant portion of the text.

The adhesive of the present invention also allows the insert sheet to be completely removed and re-inserted if necessary. This allows multiple users to annotate a single document. For example, User 1 can annotate a document such as a topical study guide that may accompany a small Bible study group. User 2 can similarly annotate the same document. Thus multiple participants can use a single document. Furthermore, by completely removing the annotation sheet so that no part of the annotated sheet remains affixed to the underlying document, the method is conducive to allowing a first participant to annotate while allowing a second participant to independently annotate without having ready access to the annotations of the first participant. This is a desirable advantage that is otherwise generally impeded when a single document is available for annotation. The adhesive aspect of the annotation sheet can conveniently enhance the ability of maintaining the annotations of the first participant proximal to the document. For instance, the annotation sheet of the first participant can be placed inside the back cover of the document.

The insert can be any size and is preferably substantially the same size as the document of interest (e.g. the page of a book to be annotated). Common page sizes for use with books range from 2½ inches by 3½ inches to 8 by 10½ inches. Additionally, sizes can include larger sizes such as maps and textbooks.

By "substantially the same size" it is meant that the length and width of the insert, aside from the tabs, is within 10% of the size of the document to be annotated. In one embodiment, the inserts are slightly smaller than the pages of a book so that they can be easily inserted into a book. It may be preferable that the insert be slightly smaller than the page so that the insert can completely fit within the book or document except for the tabs. Preferably, the tabs of the insert will protrude from the pages.

The reduced thickness allows the insert to have a relatively larger surface area compared to tape flags or smaller Post-it® notes or flags known in the art. The increased surface area provides a larger area to make notes and also enhances the ability to maintain the insert's location in the document. The ability of the insert to remain fixed to the page is affected by a combination of (a) the frictional force between the total surface area of the insert against the annotated page; (b) the frictional force/leverage factor from positioning the annotation sheet towards the binding of the book or document; and (c) the adhesive force from any adhesives on the rear face of the insert. A larger surface area will increase the frictional force between the insert and the page and results in a superior ability of the insert to stay with the document versus the common occurrence where a tape flag or conventional sticky note quickly or eventually falls out of the document. A larger surface area also means that less adhesive is required to keep the insert fixed to the document page.

Additionally, the reduced thickness allows multiple inserts to be inserted into a book or document while having a minimal effect or no effect on the overall document thickness. This allows for multiple inserts to be used while preserving the document binding structure and reducing potential for damage. This is particularly useful in hardcover bound books. For example, the insert sheet is thin enough so that it is possible to add upwards of 80 insert sheets without negatively affecting an average hard cover book having 280 pages or more. Conventional tape flags or sticky notes can be made to have surface areas as large as the inserts of the present invention, however, the thickness of these conventional inserts would result in significantly increasing the weight or deforming the shape of the book or document if multiple sheets are used.

The inserts are optionally partially or completely tinted with a color. The inserts can be any color, including but not limited to red, green, blue, white, cream, yellow, grey, mauve, burgundy, orange and combinations thereof, as long as the sheet remains at least substantially transparent. The sheet and tabs of the insert may both be tinted or un-tinted independently of each other, and may be tinted different colors. The colors can be used to emphasize particular inserts or match topics to a particular color. It is believed that colorizing the insert can highlight the underlying text making the text easier to read, particularly to those with reading disabilities such as dyslexia. Optionally, the inserts may also contain lines across the sheet similar to notebook paper. The lines can be any color, including but not limited to white, black and grey, that is easily discernable and should be thin enough so as not to block the underlying document text. For example, white lines can be used where the sheet is a darker color, or black lines can be used where the sheet is a lighter color. Additionally, the lines can be a darker shade of the sheet color, i.e., the sheet is tinted blue or cream color and has dark blue or dark tan lines.

While the invention has been described with certain preferred embodiments, it is understood that the preceding description is not intended to limit the scope of the invention. It will be appreciated by one skilled in the art that various equivalents and modifications can be made to the invention shown in the specific embodiments without departing from the spirit and scope of the invention. Every formulation or combination of components described or exemplified herein can be used to practice the invention, unless otherwise stated. Whenever a range is given in the specification, for example, a size range, a thickness range or a composition range, all intermediate ranges and subranges, as well as all individual values included in the ranges given are intended to be included in the disclosure. Moreover, any use of a term in the singular also encompasses plural forms. All publications referred to herein are incorporated herein to the extent not inconsistent herewith.

The invention claimed is:

1. A method of annotating a document comprising:

a) providing an insert where said insert comprises a sheet of transparent or substantially transparent tissue paper, tracing paper or vellum having a front face and a rear face, and one or more tabs extending from the outer edges of the sheet, wherein the surface of the front face of the sheet is receptive to pencil and ink marks, and wherein the insert further comprises a plurality of adhesive dots on the rear face of the sheet, wherein each adhesive dot has a diameter of 2 mm or less and the adhesive dots are spaced between 1 cm and 3 cm apart from one another, and wherein the plurality of adhesive dots are placed at least 1.27 cm away from the closest edge of the sheet;

b) positioning said insert relative to a separate desired document page so that the adhesive contacts the document page;

c) annotating said insert; and d) completely removing said insert from the document page without damaging or marking the document page and without ripping the insert, wherein said sheet has a thickness of between about 0.5 and about 2.5 mils.

2. The method of claim 1 wherein the insert sheet or portions of the insert sheet are tinted with a color and positioned over a desired section of the document page thereby highlighting the desired section.

3. The method of claim 1 wherein said sheet has a thickness of between about 1 and about 1.5 mils.

4. The method of claim 1 further comprising re-positioning the insert over the document page.

5. The method of claim 1 wherein the plurality of adhesive dots are placed along the side edge or top edge of the rear face of the sheet.

6. The method of claim 1 wherein the plurality of adhesive dots are placed at least 2.54 cm away from the closest edge of the sheet.

7. A method of annotating a document comprising:

a) providing an insert where said insert comprises a sheet of transparent or substantially transparent tissue paper, tracing paper or vellum having a front face and a rear face, and one or more tabs extending from the outer edges of the sheet, wherein the surface of the front face of the sheet is receptive to pencil and ink marks, and wherein the insert further comprises a plurality of adhesive dots on the rear face of the sheet, wherein each adhesive dot has a diameter of 2 mm or less and the adhesive dots are spaced between 1 cm and 3 cm apart from one another;

b) positioning said insert relative to a separate desired document page so that the adhesive contacts the document page;

c) folding a portion of the sheet while the insert is in contact with the document page, thereby exposing a portion of the document page;

d) annotating the rear face of the folded portion of the sheet; and e) completely removing said insert from the document page without damaging or marking the document page and without ripping the insert, wherein said sheet has a thickness of between about 0.5 and about 2.5 mils.

8. A method of annotating a document comprising:

a) providing a plurality of inserts where each insert comprises a sheet of transparent or substantially transparent tissue paper, tracing paper or vellum having a front face and a rear face, and one or more tabs extending from the outer edges of the sheet, wherein the surface of the front face of the sheet is receptive to pencil and ink marks, and wherein each insert further comprises a plurality of adhesive dots on the rear face of the sheet, wherein each adhesive dot has a diameter of 2 mm or less and the adhesive dots are spaced between 1 cm and 3 cm apart from one another, and wherein the plurality of adhesive dots are placed at least 1.27 cm away from the closest edge of the sheet;

b) positioning each insert relative to a separate desired document page so that the adhesive contacts the document page;

c) annotating one or more of said inserts; and d) completely removing one or more of the positioned inserts from the document pages without damaging or marking the document pages and without ripping the one or more inserts, wherein each sheet has a thickness of between about 0.5 and about 2.5 mils and wherein the plurality of annotated inserts do not substantially increase the thickness of the document.

9. An insert comprising:

a) a sheet of transparent or substantially transparent tissue paper, tracing paper or vellum having a front and rear face, and one or more tabs extending from the outer edges of the sheet, wherein the surface of the front face of the sheet is receptive to pencil and ink marks and said sheet has an area density between about 10 and about 60 grams per square meter and a thickness between about 0.5 and about 2.5 mils, and b) a plurality of adhesive dots on the rear face of the sheet, wherein each adhesive dot has a diameter of 2 mm or less and the adhesive dots are spaced between 1 cm and 3 cm apart from one another, wherein the plurality of adhesive dots are at least 1.27 cm away from the closest edge of the sheet, and wherein said insert is able to be attached to a desired document page so that the adhesive contacts the document page, and the insert is able to be completely removed from said document page without damaging or marking the document page and without ripping the insert.

10. The insert of claim 9 wherein said sheet has an area density between about 10 and about 40 grams per square meter.

11. The insert of claim 9 wherein said sheet has an area density between about 15 and about 30 grams per square meter.

12. The insert of claim 9 wherein the plurality of adhesive dots are placed along the side edge or top edge of the rear face of the sheet.

13. The insert of claim 9 wherein the plurality of adhesive dots are at least 2.54 cm away from the closest edge of the sheet.

14. The insert of claim 9 wherein the transparent or substantially transparent sheet is tinted with a color.

15. The insert of claim 9 wherein the sheet contains a plurality of visible lines.

16. The insert of claim 9 wherein the sheet has dimensions between 2½ inches by 3½ inches to 8 inches by 10½ inches.

17. The insert of claim 9 wherein the sheet has a thickness between about 1 and about 1.5 mils.

18. The insert of claim 9 wherein the rear face of the sheet does not contain any compound or material that will mark the underlying document page when the front face of the sheet is written on or pressed on.

* * * * *